United States Patent [19]

Archibald

[11] Patent Number: 5,008,863

[45] Date of Patent: Apr. 16, 1991

[54] LOW NOISE SONAR SUPPORT SYSTEM

[75] Inventor: Frank S. Archibald, State College, Pa.

[73] Assignee: The United States of America as represented by the Secretary of the Navy, Washington, D.C.

[21] Appl. No.: 47,551

[22] Filed: Jun. 4, 1979

[51] Int. Cl.[5] ..... H04R 17/00

[52] U.S. Cl. ..... 367/165; 367/12; 114/275; 114/280

[58] Field of Search ..... 367/165, 12, 173, 104, 367/106, 130; 114/275-277, 280, 282

[56] References Cited

U.S. PATENT DOCUMENTS

| | | | |
|---|---|---|---|
| Re. 26,059 | 7/1966 | Meyer et al. | 114/280 |
| 2,426,657 | 9/1947 | Williams | 367/12 |
| 2,832,944 | 4/1958 | Kessler | 367/173 |
| 3,027,539 | 3/1962 | Stillman, Jr. | 367/173 |
| 3,027,862 | 4/1962 | Votre | 114/282 |
| 3,106,437 | 10/1963 | Michalski | 367/130 |
| 3,130,702 | 4/1964 | Fischer | 114/275 |
| 3,618,006 | 11/1971 | Wright | 367/173 |
| 3,740,706 | 6/1973 | Joseph | 367/173 |
| 3,781,780 | 12/1973 | Dow | 367/173 |
| 3,812,806 | 5/1974 | Korot Kou | 114/280 |
| 3,910,215 | 10/1975 | Soderman | 114/279 |
| 3,910,216 | 10/1975 | Shultz | 114/275 |

FOREIGN PATENT DOCUMENTS

| | | | |
|---|---|---|---|
| 1075989 | 2/1960 | Fed. Rep. of Germany | 367/173 |

*Primary Examiner*—Harold J. Tudor

*Attorney, Agent, or Firm*—Michael J. McGowan; Prithvi. C. Lall

[57] ABSTRACT

A sonar support system that is suspended beneath a ship in a low drag U-shaped hydrofoil mounting assembly is provided. The assembly is attached at its upper end to suitable means for pivotally rotating the transverse hydrofoil strut containing a sonar array from a streamed position under the ship's hull to a maintenance or stowed position in brackets on the ship's forward deck. The tranverse strut may be positioned at varying distances below the hull, and the assembly including vertical struts may be constructed to pivot about an axis above or below the waterline as required.

2 Claims, 2 Drawing Sheets

LOW NOISE SONAR SUPPORT SYSTEM

This invention concerns marine hydrophone transducers and, more particularly, means for mounting such transducers remote from a vessel's hull to reduce the high background noise level in internal bow mountings primarily caused by turbulence.

Hydrophone transducers presently mounted in ship's or vessel's bows are subjected to a high noise level associated with the turbulence generated by the bow as it passes through the water. This noise level is especially troublesome to sonar systems wherein a portion thereof is housed in a bulbous structure attached directly to the ship at the bow since such structures are particularly susceptible to high background noise due to both water flow and mechanical vibration. The flow noise has been attributed to the transition to turbulence and also the turbulent flow of the boundary layer over the sonar dome as well as the wave-making noise of the ship. The background level of mechanical vibration of the sonar system is determined by the efficiency of any vibration isolation techniques employed to reduce the transmission of the ship's mechanical vibration to the sonar transducers.

Prior attempts to significantly reduce noise levels associated with such water flow and/or mechanical vibration have included stabilizing the underwater sound apparatus mounting within the vessel's hull, attaching a streamlined housing to the hull underbody, and mounting a transducer on a boom pivotally connected to the forward deck for deployment ahead of the vessel and thus away from the submerged portion of the hull. These prior methods of deployment are either too remote during vessel operation to afford close control or adjustment or present too great an impediment to operation of the vessel, among other disadvantages. The present invention avoids the deficiencies of prior methods and devices and provides a transducer system mounting that permits close control and positioning, the use of hydrofoil technology, and a laterally extended sonar array, among other advantages.

Accordingly, it is an object of the present invention to provide a low background noise level support and housing for a ship's sonar system.

Another object of this invention is to provide a mounting for a ship's sonar system that does not have the structural constraints that the bow of a ship imposes.

A further object of this invention is to provide a mounting for a ship's sonar system that achieves low flow noise levels by maintaining laminar flow over the mounting plus a low vibration level and very low angle of attack thereof.

Other objects, advantages and novel features of the invention will become apparent from the following detailed description thereof when considered in conjunction with the accompanying drawings in which like numerals represent like parts throughout and wherein.

The present invention, in general, concerns a sonar support system that is suspended beneath a ship in a low drag mounting such as hydrofoil struts which afford low flow noise. The mounting is attached at its upper end to suitable means for pivotally rotating the mounting assembly onto the deck of the ship for maintenance or stowage or to decrease the ship's draft as required. The transverse strut may be positioned at varying distances below the hull, and the mounting assembly including vertical struts may be adapted to pivot about an axis above or below the waterline as desired or dictated by operational requirements.

Figure 2:
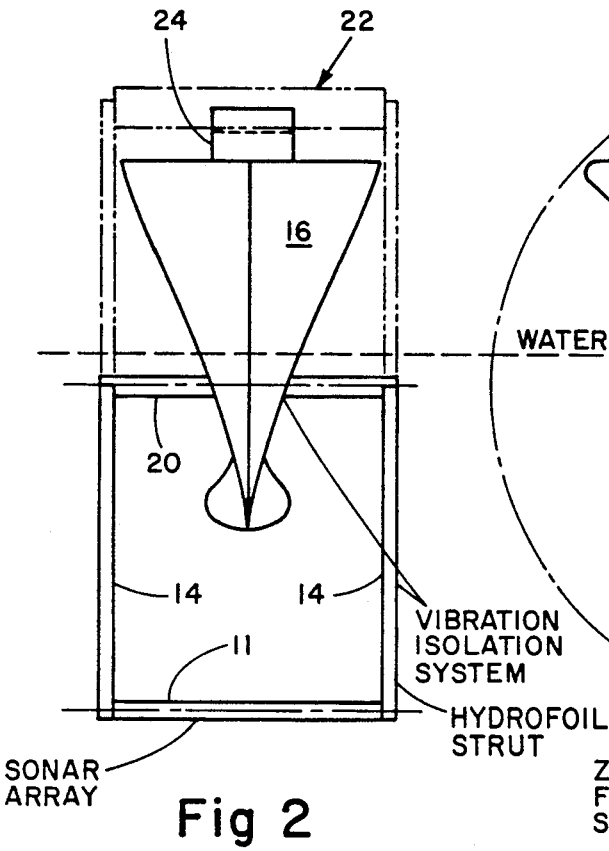
FIG. 2 is a front elevation of the support system of FIG. 1.
Figure 1:
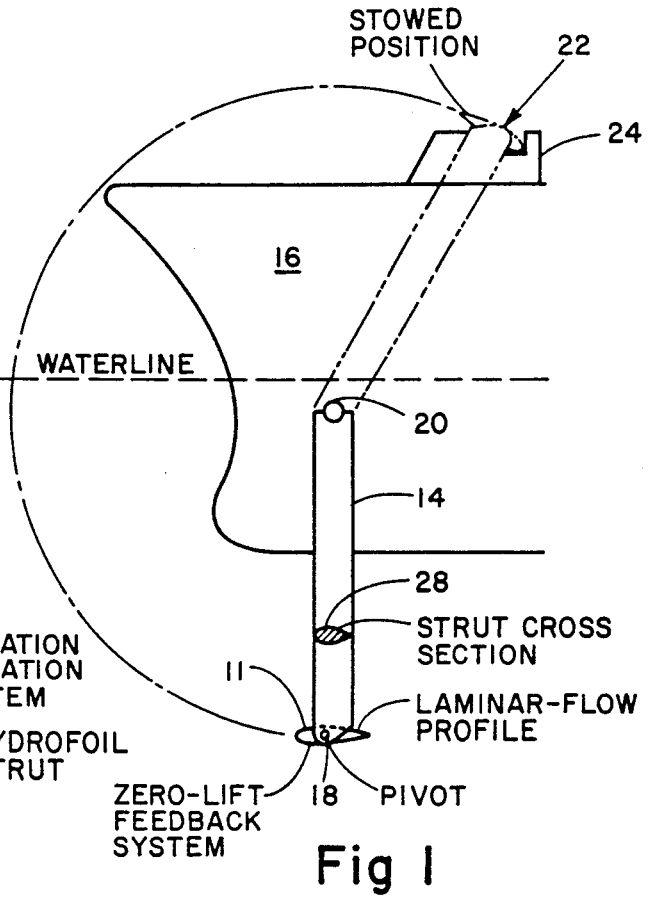
FIG. 1 is a side elevation of the sonar support system of the present invention mounted on a ship's hull with an attaching pivot below the waterline.
Figure 4:
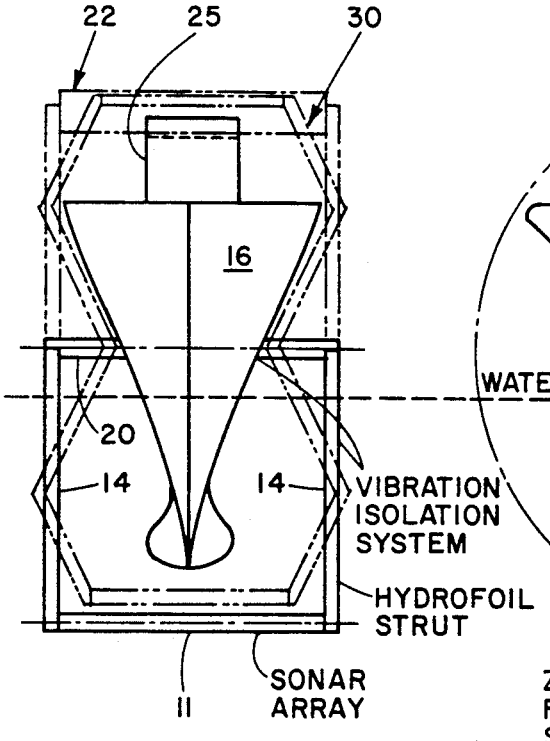
FIG. 4 is a front elevation of the support system of FIG. 3.
Figure 3:
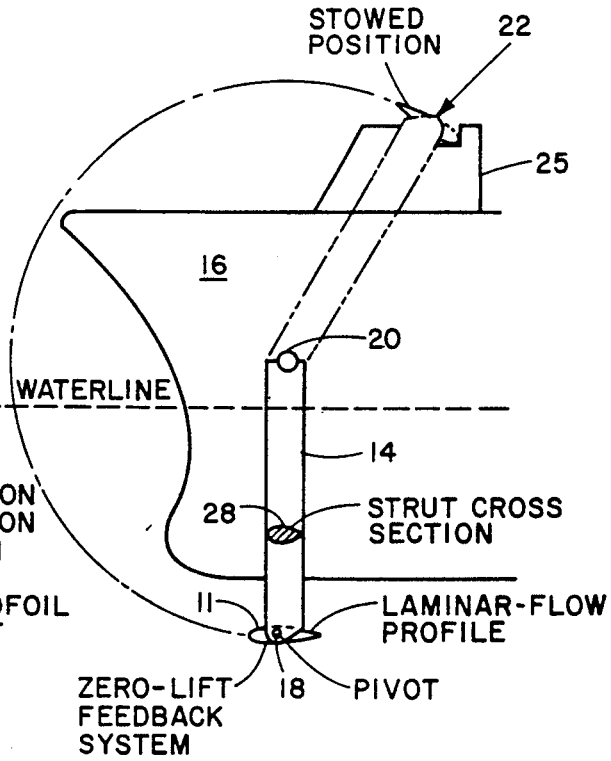
FIG. 3 is a side elevation of the sonar support system of FIG. 1 mounted with an attaching pivot above the waterline.

Referring to the drawings, FIGS. 1 and 3 show a hydrofoil 11 in which sonar system transducers are positioned to present a suitable laminar-flow profile for the ship's speeds anticipated during operation of the sonar system. This system would generally include internally disposed circuits, electronic equipment, etc. which are not shown as they are not necessary to an understanding of the invention. The pertinent externally disposed components of the system include at least a pair of vertical hydrofoil struts 14 which pivotally support hydrofoil 11 at its ends a substantial distance from a ship's hull 16 about a pivot axle 18 as shown in FIGS. 2 and 4, a transverse axial member 20 for pivotally supporting struts 14, and conventional means, not shown, for rotating struts 11 and 14 from their operational position shown in solid line to a retracted position shown at 22 for servicing, stowage, etc. in deck receptacles 24 and 25, respectively. A section of struts 14 is shown at 28.

Figure 5:
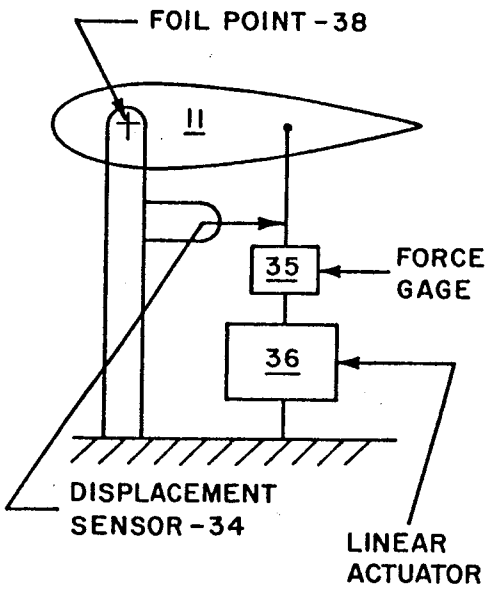
FIG. 5 is a schematic diagram showing the components for sensing forces acting on the hydrofoil.
Figure 6:
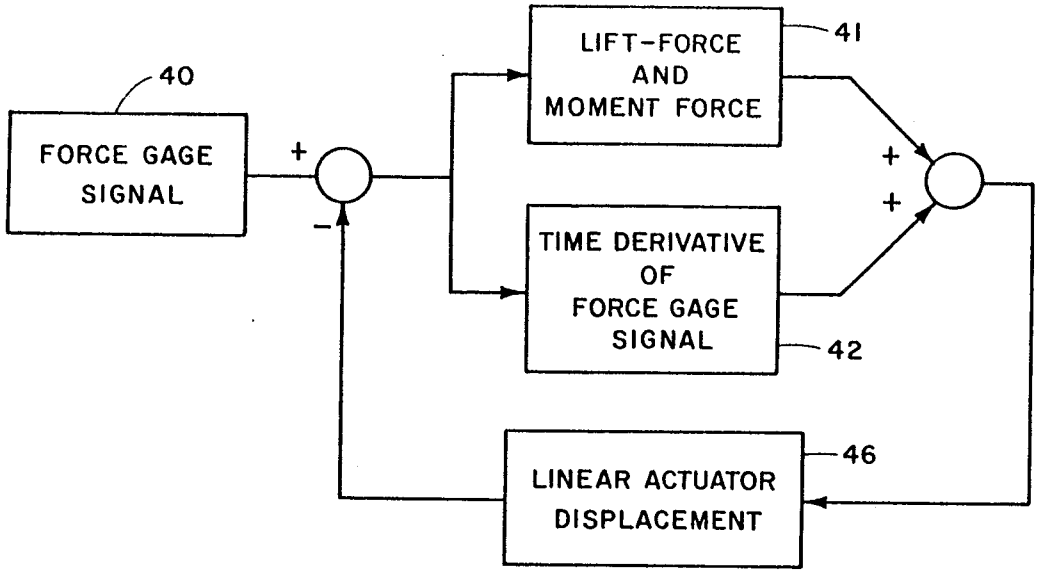
FIG. 6 is a block diagram of a feedback system for achieving zero hydrofoil lift.

FIG. 5 is a schematic diagram of a zero-lift feedback control system for maintaining a desired zero angle of attack of hydrofoil 11 so as to cause minimum flow noise among other advantages. This condition is achieved by maintaining hydrofoil 11 in a no-lift attitude. A displacement sensor 34, a force gage 35 and a linear actuator 36 are installed in the hydrofoil for sensing and compensating for lift forces acting on the hydrofoil. Sensor 34 detects surface pressure changes caused by rotary movement of the hydrofoil about a pivot axis or foil point 38 which movement generates a force gage signal representative of clockwise (+) or counterclockwise (−) rotation as indicated at block 40 in FIG. 6. This signal is fed simultaneously to components 41 and 42 in FIG. 6 and the resulting signal generates a linear actuator displacement signal 46 which is combined with the force gage signal to activate linear actuator 36 and produce a corrective counter rotation of the hydrofoil until a zero-lift force is obtained.

Figure 7:
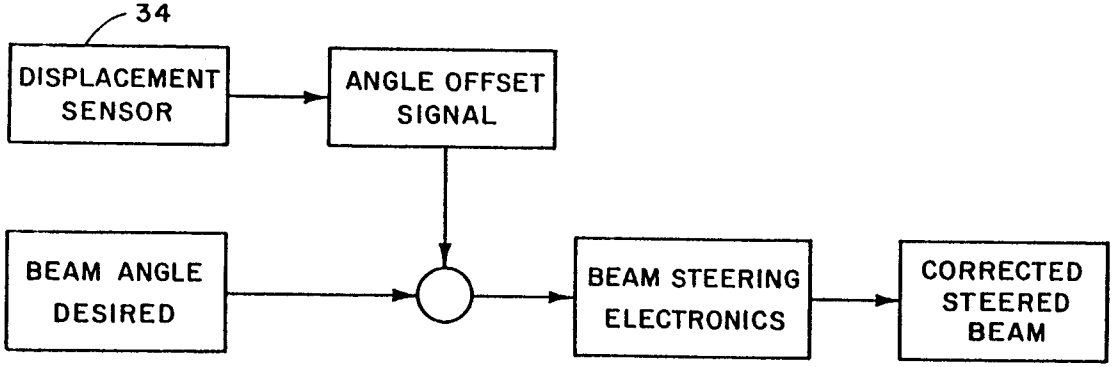
FIG. 7 is a block diagram of components for correcting beam angle in relation to hydrofoil attitude.

The control system conventionally uses an electronically weighted output from the corrective or error signal, to obtain a desired degree of anticipation, to drive actuator 36. That is, if hydrofoil 11 were pivoted forward of the ¼ chord point it would tend to align itself with the direction of the instantaneous flow. However, due to its rotary inertia it could lag the change in flow direction, and the feedback control system in FIG. 6 would decrease the deviation in angle of attack from the zero value. It should be noted that any output from force gage 35 is an error signal. FIG. 7 is a block diagram of conventional components for conventionally correcting beam angle in relation to hydrofoil attitude.

In operation, low flow noise hydrofoil 11 houses the portion of the sonar system to be isolated, not shown, which is suspended beneath ship 16 by low drag hydrofoil struts 14. Struts 14 are attached to and supported by axial member 20 which is conventionally connected within the hull to suitable means for both pivoting hydrofoil 11 about pivot 18 and rotating the entire hydrofoil assembly about axial member 20 so as to terminate in receptacles 24 and 25 for maintenance or to decrease the ship's draft. Control of hydrofoil 11 is effected through internally disposed equipment which acts directly upon axial member 20 within ship's hull 16 to deploy and stow the system and via member 20 and struts 14 to pivot hydrofoil 11 to the optimum laminar-flow profile. The zero-lift feedback system shown in FIGS. 5 and 6 preferably is placed at each end of hydrofoil 11 to adjust its angle of attack as desired.

It will be appreciated that the invention utilizes advantageously the development, mountings and controls of hydrofoils, which in effect are the underwater equivalent of an aerial wing, to not only reduce flow noise and drag but to permit use of a laterally larger sonar array than is possible with bulbous bows or boom-supported mountings. Although laminar flow sections are presently available in the hydrofoil art for maintaining pressure gradients over a large percentage of the hydrofoil chord, these sections have smaller pressure peaks and thus more favorable, i.e. higher, cavitation speeds than the four-digit and five-digit series of hydrofoil sections of the widely known National Advisory Committee for Aeronautics profiles. All series have a basic thickness distribution formed about a cambered mean line. The four-digit and five-digit series have maximum thickness at 30 percent chord and large pressure peaks far forward.

Low flow noise levels are achieved by maintaining laminar flow over the selected hydrofoil configuration. Two conditions that are necessary to maintain laminar flow on the surface of a hydrofoil are a low vibration level and a very low angle of attack. The low vibration level is achieved by vibration isolation of either or both the rotating drive mechanism for axial member 20 and the hydrofoil struts. The low or preferably zero angle of attack of hydrofoil 11 is maintained for all lift-producing ship motions by the conventional hydrofoil feedback control circuit shown that nulls the hydrofoil lift to zero by rotating the hydrofoil about lower pivot 18 which coincides with foil point 38. In order to maintain the same sonar receiving angle, the sonar array is "steered" or corrected by the angular amount the hydrofoil is rotated as shown in FIG. 7.

There is thus provided a low background noise level support and housing for a ship's sonar system in which vibration isolation techniques are more effective because the assembly does not have the structural constraints that the bow of a ship imposes. In addition, low flow noise levels can be obtained by a hydrofoil 11 configuration that is not constrained by a hull shape designed for low drag to achieve a laminar flow boundary layer to large chordwise length. Also, the sonar array can be laterally larger than that permitted by the bulbous bow region of a ship, resulting in an increased resolution of a target noise source, among other advantages.

Obviously many modifications and variations of the invention are possible in the light of the above teachings. For example, an assembly can be configured to conform more closely to a ship's hull as indicated at 30 in FIG. 4 within the concept of the invention.

What is claimed is:

1. A sonar support system for deploying a sonar array remote from a vessel comprising:

a transversely extended hydrofoil-shaped member adapted for deployment beneath said vessel, said transverse member being pivotable in the streamed position and further including means for determining the position of zero lift therein at various vessel attitudes and means including a feedback system for pivoting said transverse member to a zero-lift position and maintaining said member at said position;

a sonar array positioned in said transverse member;

a pair of struts for supporting said transverse member, one at each end;

rotatable means connected to said struts and extending from said vessel for supporting and rotating said struts, said rotatable means further including coaxial rods which extend a distance from each side of said vessel's hull sufficient to allow clearance therefrom of said struts, said struts being joined at an outwardly extending angle to said rotatable means so as to extend substantially parallel to said vessel's hull when in the vertically upward position, said struts being turned at an inwardly extending angle substantially at the vessel's gunwhale in the vertically upward position so as to converge and said transverse member connected to said converging struts at points sufficient to allow clearance of said vessel's underbody when in the vertically downward position;

a sonar system in said vessel and means connecting said sonar array to said sonar system;

means for rotating said rotatable means so as to pivot said transverse member between a position beneath said vessel, clear of the bow thereof, and a position on the deck of said vessel; and means on the deck of said vessel for nesting said transverse member, whereby said sonar array may be deployed at selected depths beneath said vessel and readily removed for maintenance and when necessary to limit the draft of the vessel.

2. A sonar system for use with a surface ship, comprising:

a sonar array;

rotatable means mounted in and extending laterally from the hull of said ship for supporting and rotating said sonar array, said rotatable means further including coaxial axle members which extend a distance from each side of said vessel's hull sufficient to allow clearance therefrom of said struts, said struts being joined at an outwardly extending angle to said rotatable means so as to extend substantially parallel to said vessel's hull when in the vertically upward position, said struts being turned at an inwardly extending angle substantially at the vessel's gunwhale in the vertically upward position so as to converge and said transverse member connected to said converging struts at points sufficient to allow clearance of said vessel's underbody when in the vertically downward position;

at least a pair of struts connected one at each end to the outer ends of said rotatable means and extending a sufficient distance therefrom to space said sonar array a selected distance from the underbody of said ship in the streamed position and on deck in the service or stowed position;

a transverse member pivotally connected to the remote ends of said struts and adapted to receive said sonar array;

a displacement sensor operatively connected to said transverse member for sensing vessel lift forces acting on said transverse member;

a sonar control system in said vessel and means connecting said system to said array through said struts and said rotatable means; and a linear actuator responsive to signals from said displacement sensor and adapted to rotate said transverse member counter to forces acting thereon to obtain a zero force attitude therein.

* * * * *